US005568707A

United States Patent [19]

Ishikawa et al.

[11] Patent Number: 5,568,707

[45] Date of Patent: Oct. 29, 1996

[54] SOLARIUM STRUCTURE

[75] Inventors: Masayoshi Ishikawa; Edward T. Fitzhenry, Jr., both of Dublin, Ga.

[73] Assignee: YKK Corporation of America, Lyndhurst, N.J.

[21] Appl. No.: 377,010

[22] Filed: Jan. 23, 1995

[51] Int. Cl.[6] ..... E04B 7/18

[52] U.S. Cl. ..... 52/200; 52/93.1; 52/204.57; 52/209

[58] Field of Search ..... 52/200, 93.1, 204.57, 52/209, 280, 277

[56] References Cited

U.S. PATENT DOCUMENTS

| | | | |
|---|---|---|---|
| 3,196,992 | 7/1965 | Owen . | |
| 3,830,029 | 8/1974 | Vance | 52/395 |
| 4,070,806 | 1/1978 | Hubbard | 52/90 |
| 4,100,704 | 7/1978 | Oogami | 52/65 |
| 4,114,330 | 9/1978 | Sukolice | 52/200 |
| 4,296,576 | 10/1981 | Rice, Jr. et al. | 52/90 |
| 4,327,532 | 5/1982 | Matthews | 52/92 |
| 4,638,613 | 1/1987 | Tönsmann | 52/200 X |
| 4,680,905 | 7/1987 | Rockar | 52/200 |
| 4,683,693 | 8/1987 | Rockar et al. | 52/235 |
| 4,773,193 | 9/1988 | Biebuyck | 52/93 |
| 4,998,389 | 3/1991 | Pritts | 52/90 |

*Primary Examiner*—Carl D. Friedman
*Assistant Examiner*—Yvonne Horton-Richardson
*Attorney, Agent, or Firm*—Finnegan, Henderson, Farabow, Garrett & Dunner, L.L.P.

[57] ABSTRACT

A solarium structure (S) is comprised of a vertical wall frame (3); a sloped roof frame (1) mounted thereon. The vertical wall frame (3) includes two mullions (13) and a head (9) joined at the opposed ends with the sides of the upper ends of the mullions (13), the head (9)having a first-mentioned circular-arc surface (143) formed throughout the entire length thereof. The sloped roof frame (1) includes two rafters (17) and a bottom purlin (23) joined at the opposed ends with the sides of the lower ends of the rafters (17), the bottom purlin (23) having a second-mentioned circular-arc surface (163) formed throughout the entire length thereof. The lower ends of the rafters (17) are mitered to the upper ends of mullions (13). The bottom purlin (23)is placed on the head (9) with the second-mentioned circular-arc surface (163) of the former coming into surface-to-surface engagement with the first-mentioned circular-arc surface (143) of the latter so that the head (9) and bottom purlin (23) can be angularly adjusted to each other and so that draft and light can be prevented from passing between the sloped roof frame (1) and the vertical wall frame (3). The solarium structure (S) further includes means (183) for joining the lower ends of the rafters (17) and the upper ends of the mullions (13) so as to be angularly adjusted to each other.

5 Claims, 6 Drawing Sheets

SOLARIUM STRUCTURE

BACKGROUND OF THE INVENTION

1. Field of the Invention

The present invention relates generally to a solarium structure, and particularly to a solarium structure including a sloped roof frame and vertical wall frame, the sloped roof frame mounted on the vertical wall frame so as to be angularly adjusted relative to each other, and the sloped roof frame and the vertical wall frame being joined to each other in such a way to prevent draft and light from passing therebetween.

2. Description of the Prior Art

A typical solarium structure of the type described is disclosed in U.S. Pat. No. 4,100,704. The disclosed solarium structure is comprised of a sloped roof frame and a vertical wall frame, the sloped roof frame having a plurality of rafters and a plurality of purlins interconnected to provide a chessboard-like pattern frame, the vertical wall frame having a plurality of heads, a plurality of sills and a plurality of vertical mullions interconnected to thus provide a chessboard-like pattern frame. The rafters of the sloped roof frame are disposed in vertical alignment with and mitered to the corresponding vertical mullions of the vertical wall frame so that the sloped roof frame is mounted on the vertical wall frame.

Each head of the vertical wall frame has an elongated circular-arc surface disposed on the top, formed throughout the entire length thereof and extending arcuately backward. Each bottom purlin of the sloped roof frame is of a channel-cross-section and is comprised of a base and a pair of top and lower plates, the upper plate extending forward and having a downward-projecting engaging tip. The engaging tip of the bottom purlin is adapted for line-to-surface engagement with the circular arc-surface of the head.

This solarium structure, however, suffers from some drawbacks.

The lower end of each rafter and the upper end of the respective vertical mullion are only butt-fitted to each other and there is no means for joining the rafter end and the mullion end firmly against displacing from each other, especially laterally thereof. In order to make up for the lack of specific joining means, each bottom purlin joining the lower ends of each adjacent rafters must be fastened to the respective head joining the upper ends of each adjacent vertical mullions by screwing them at intervals. This fastening operation of the bottom purlins to the respective heads is very tedious and time-consuming.

Furthermore, since the engaging tip of the bottom purlin is in line-to-surface engagement with the circular-arc-surface of the head; the tip is more likely to be detached from the circular-arc surface of the head—especially when the sloped roof frame is under distortion due to heavy wind road—to thus provide gaps through which draft and light pass.

With the foregoing difficulties in view, it is therefore an object of the present invention to provide a solarium structure which is simple in construction, easy to manufacture and to install at a job site and highly strong even under heavy stresses.

It is another object of the present invention to provide a solarium structure wherein the sloped roof frame is easy to angularly adjust relative to the vertical wall frame in conformity with the angle at which the corresponding ends of the rafter and the mullion are mitered to each other.

It is still another object of the present invention to provide a solarium structure where draft and light are well prevented from passing between the sloped roof frame and the vertical wall frame.

According to the present invention, there is provided a solarium structure comprising a vertical wall frame; a sloped roof frame mounted thereon; the vertical wall frame including two mullions and a head joined at the opposed ends with the sides of the upper ends of the mullions, the head having a first-mentioned circular-arc surface formed throughout the entire length thereof; the sloped roof including two rafters and a bottom purlin joined at the opposed ends with the sides of the lower ends of the rafters, the bottom purlin having a second-mentioned circular-arc surface formed throughout the entire length thereof; the lower ends of the rafters being mitered to the upper ends of mullions; the bottom purlin being placed on the head with the second-mentioned circular-arc surface of the former coming into surface-to-surface engagement with the first-mentioned circular-arc surface of the latter so that the head and bottom purlin can be angularly adjusted to each other and so that draft and light can be prevented from passing between the sloped roof frame and the vertical wall frame; and means for joining the lower ends of the rafters and the upper ends of mullions so as to be angularly adjusted to each other.

Many other advantages and features of the present invention will become manifest to those versed in the art upon making reference to the detailed description and the accompanying sheets of drawings in which preferred structural embodiments incorporating the principles of the present invention are shown by way of illustrating sample.

DETAILED DESCRIPTION

Figure 1:
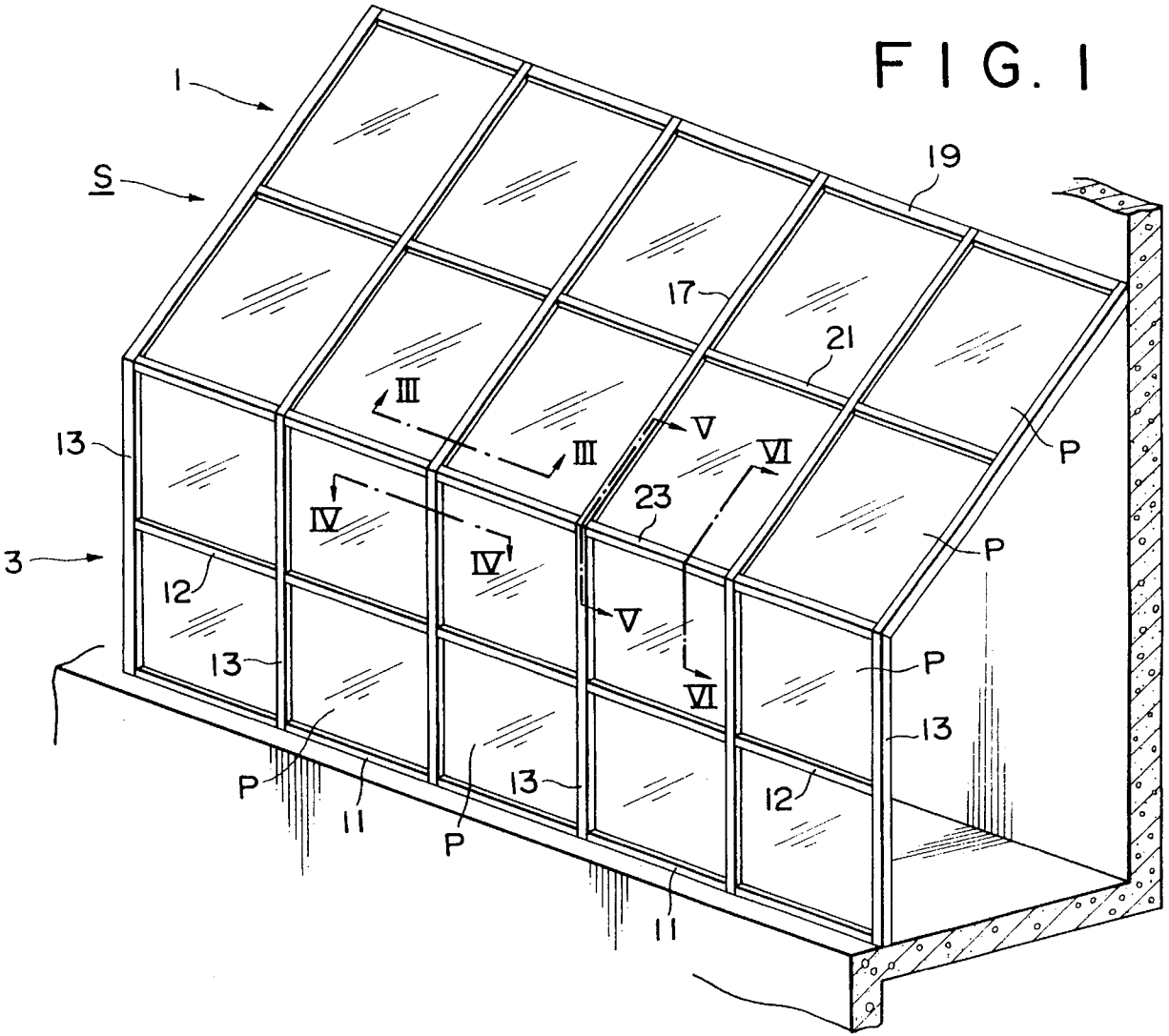
FIG. 1 is a perspective view of a solarium, partly cut away, according to the present invention.

FIG. 1 shows a solarium S according to the present invention which is installed at the top of a building (not shown) so as to obtain maximum sunshine. The solarium S includes a sloped roof frame 1, a vertical wall frame 3 and a pair of side frames (not shown for brevity). Instead of side frames, both sides of the solarium S may be covered by a pair of concrete walls or brick walls or other like structures.

Figure 2:
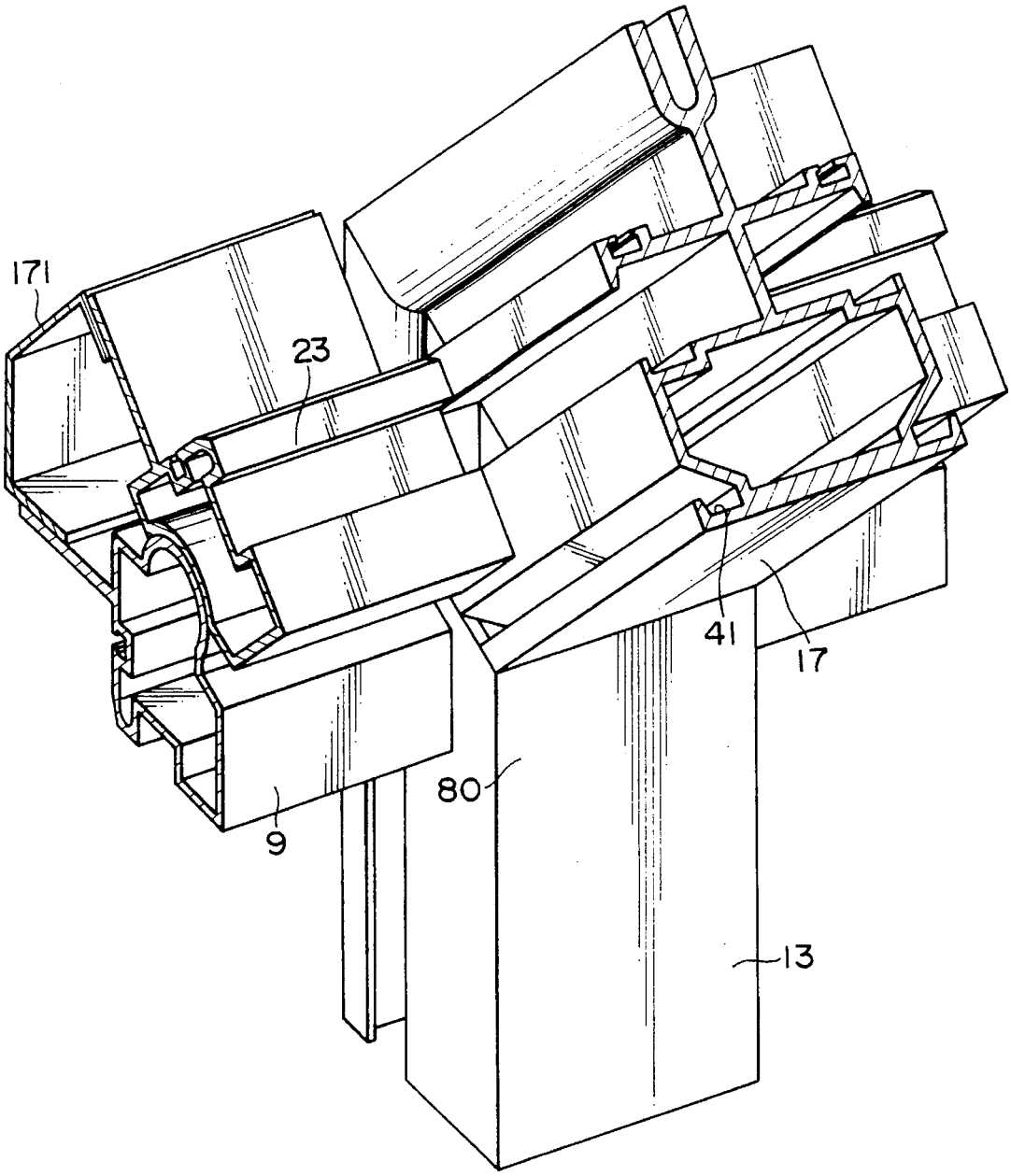
FIG. 2 is a perspective view of an intersection region of the solarium where a rafter, a vertical mullion, two adjoining bottom purlins and two adjoining heads are joined together.

As seen from FIGS. 1 and 2, the vertical wall frame 3 is comprised of a plurality of vertical mullions 13 arranged perpendicularly at intervals, a plurality of heads 9 each joined at its opposed ends with the upper ends of each adjoining vertical mullions 13, a plurality of intermediate rails 12 each joined at its opposed ends with the middles of each adjoining vertical mullions 13 and a plurality of sills 11 each joined at its respective ends with the lower ends of the adjoining vertical mullions 13 to provide a plurality of glazing openings.

A plurality of glazing panels P are fitted into the glazing openings of the vertical wall frame 3. Because the general construction of the vertical wall frame 3 is well known in this technical field and does not constitute an essential part of this invention, no further explanation thereon will be made here.

As shown in FIG. 1, a plurality of parallel spaced rafters 17 and three parallel spaced purlins; that is top, middle and bottom or lowermost purlins 19, 21, 23, respectively, are interconnected with each other to thus provide the sloped roof frame 1 and ten glazing openings. The glazing panels P are fitted into the glazing panels P. Since the general constructions of the top and the middle purlins 19, 21 do not constitute an essential part of this invention, no further explanation thereof will be made here either.

Figure 3:
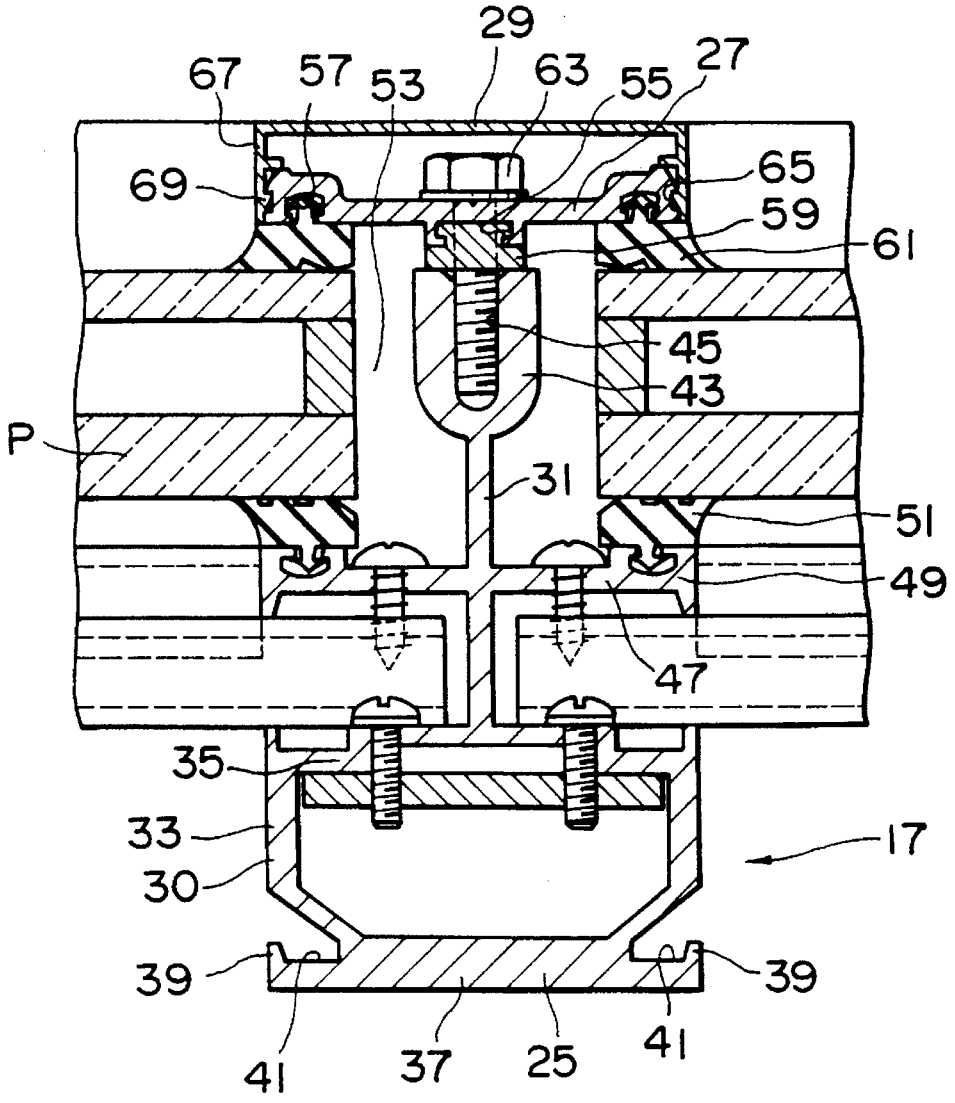
FIG. 3 is an enlarged cross-sectional view taken on line III—III of FIG. 1.

As shown in FIG. 2, the rafter 17 is an elongated profile preferably made of extruded aluminum. As better shown in FIG. 3, the rafter 17 is broadly comprised of a rafter body 25, a rafter presser plate 27 and a rafter cover 29. The rafter body 25 is comprised of a lower hollow base 30, of rectangular cross-section, an upper vertical rafter web 31 of the criss-cross cross-section provided on the lower hollow base 30. The lower hollow base 30 includes a pair of parallel, vertical, spaced apart side walls 33 and a top and bottom wall 35, 37 interconnected with the vertical side walls 33. The lower parts of the side walls 33 are converged toward the bottom wall 37 and the bottom wall 37 extends outwardly beyond the opposed side walls 33 and has its opposed edges 39 turned upward to provide a pair of rafter gutters 41 on opposite sides of the lower hollow base 30. The upper rafter web 31 is centrally disposed on and extending upward from the top wall 35 of the hollow base 30. The upper rafter web 31 has an upper thickened portion 43 at the upper end. The upper thickened portion 43 has a upward open groove 45 formed throughout thereof. The upper rafter web 31 further includes a pair of horizontal flanges 47 extending horizontally outwardly of the rafter web 31. These flanges 47 have thickened upstanding ribs 49 along their outer edges. The ribs 49 have recesses formed in their upper surfaces to receive the tongue of a resilient gasket strip 51 used for supporting and sealing the adjacent underside of glazing panels P along their corresponding edges. The rafter web 31 and the opposed horizontal flanges 47 cooperate to partly form a pair of longitudinally extending glazing channels or pockets 53 one on each side of the rafter web 31 for receiving the sloping edge portions of the roof gazing panels P. Here in FIG. 3, dual-layer glazing panels P are shown to be used, nevertheless, single-layer glazing panels P can be used, too. In that event, the upstanding ribs 49 are made slightly higher to provide a narrower glazing pocket 53 for the single-layer panels P.

The rafter presser plate 27 is made of a substantially flat elongated plate. The presser plate 27 has on its lower side one wide central groove 55 and two narrow side grooves 57 formed on the opposite sides of the central groove 55. An insulating spacer strip 59 is fitted into the central groove 55 and sealing strips 61 are fitted into the side grooves 57. The presser plate 27 is placed onto the thickened upper portion 43 of the rafter body 25 with the insulating spacer strip 59 interposed therebetween and with the sealing strips 61 interposed between the presser plate 27 and the glazing panels P. Caulking compound may be provided outwardly along the sealing strips 61 to further enhance the sealing effect. For securing the presser plate 27 to the thickened upper portion 43 of the rafter body 25, a plurality of cap screws, spaced apart, or other threaded fasteners 63 project downwardly into self-tapping threaded engagement with an upwardly opening central recess 45 formed in the thickened upper portion 43 of the rafter body 25. The presser plate 27 further has a pair of side notches 65 formed one on each side. The cover 29 is of a channel shape and includes two side flanges 67 and two lugs 69 formed along the lower edges of the side flanges 67. The cover 29 is pressed against the presser plate 27 so as to bring the engaging lugs 69 into snap-in engagement with the side notches 65 of the presser plate 27.

Figure 4:
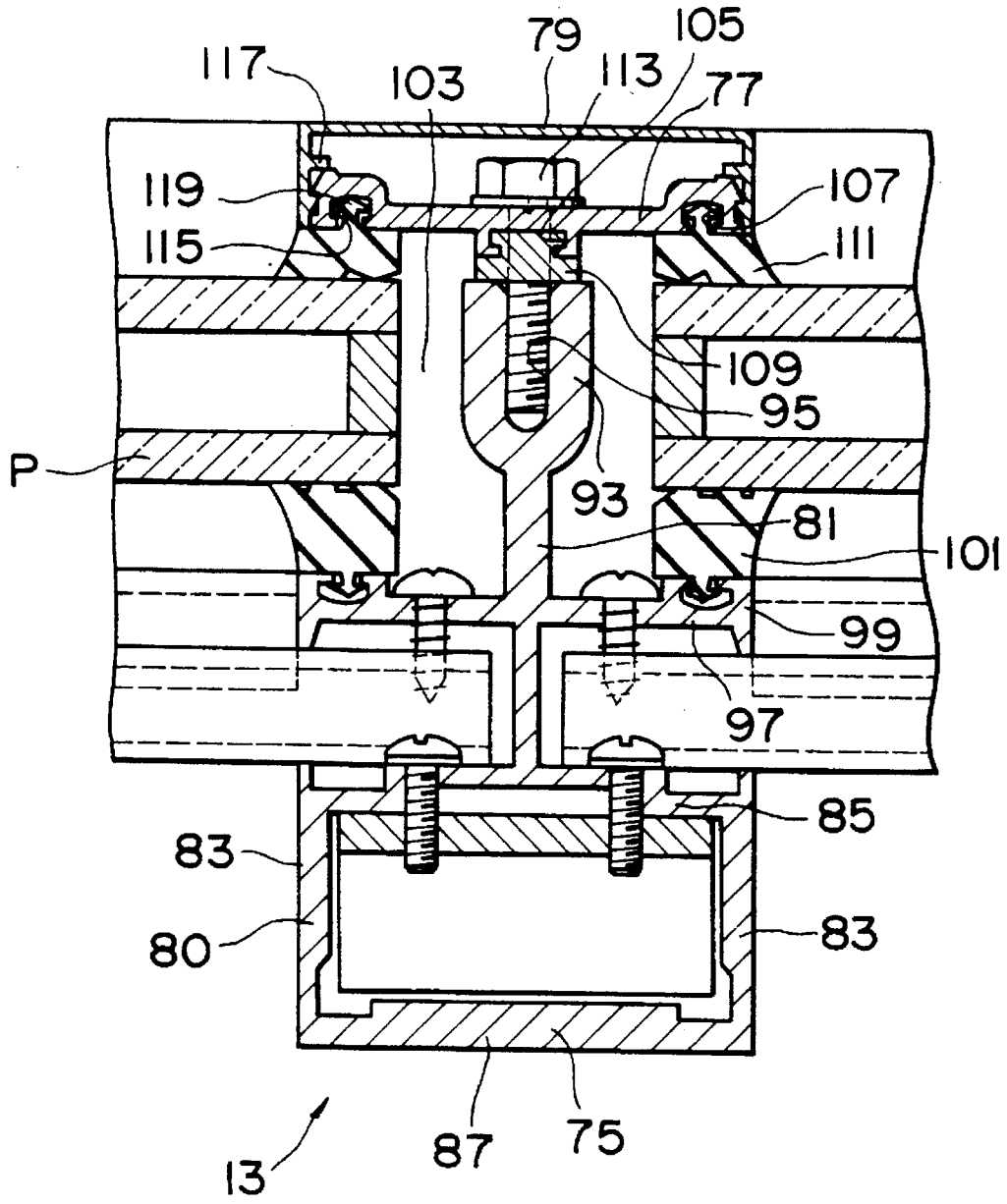
FIG. 4 is an enlarged cross-sectional view taken on line IV—IV of FIG. 1.

As shown in FIG. 2, the vertical mullion 13 is an elongated profile preferably made of extruded aluminum, too. As better seen from comparison of FIGS. 3 and 4, the vertical mullion 13 is substantially identical in cross-sectional shape with the rafter 17 except that the vertical mullion 13 is devoid of what corresponds to the opposed gutters 41 provided on the lower hollow base 30 of the rafter 19 and that what corresponds to the upper vertical mullion web 81 is somewhat thicker than the upper vertical web 31. Specifically, the vertical mullion 13 is comprised of a mullion body 75, a mullion presser plate 77 and a mullion cover 79. The mullion body 75 is comprised of a lower hollow base 80, of rectangular cross-section, an upper vertical mullion web 81 of the criss-cross cross-section provided on the lower hollow base 80. The upper vertical mullion web 81 of the vertical mullion 13 is formed thicker than the upper vertical web 31 of the rafter 17. The lower hollow base 80 includes a pair of parallel, vertical, spaced apart side walls 83 and a top and bottom wall 85, 87 interconnected with the vertical side walls 83. As better shown in FIG. 2, when the lower end of the rafter 17 is mitered to the upper end of the vertical mullion 13, the opposed rafter gutters 41 communicate with the inner hollow of the lower hollow base 80 of the vertical mullion 13, so that condensed and infiltrated water running down the rafter gutters 41 can flow into the inner hollow of he hollow base 80 and is discharged through weep holes (not shown). The upper mullion web 81 is centrally disposed on and extending upwardly from the top wall 85 of the hollow base 80. The upper mullion web 81 has an upper thickened portion 93 at the upper end. The upper thickened portion 93 has a upward open groove 95 formed throughout thereof. The upper mullion web 81 further includes a pair of horizontal flanges 97 extending horizontally outwardly of the mullion web 81. These flanges 97 have thickened upstanding ribs 99 along their outer edges. The ribs 99 have recesses formed in their upper surfaces to receive the tongue of a resilient gasket strip 101 used for supporting and sealing the adjacent underside of glazing panels P along their corresponding edges. The mullion web 81 and the opposed horizontal flanges 97 cooperate to partly form a pair of longitudinally extending glazing channels or pockets 103 one on each side of the mullion web 51 for receiving the sloping edge portions of the roof gazing panels P. Here in FIG. 4, dual-layer glazing panels P are shown to be used, nevertheless, single-layer glazing panels P can be used, too. In that event, the upstanding ribs 99 are made slightly higher to provide a narrower glazing pocket 103 for the single-layer panels P.

The mullion presser plate 77 is made of a substantially flat elongated plate. The presser plate 77 has on its lower side one wide central groove 105 and two narrow side grooves 107 formed on the opposite sides of the central groove 105. An insulating spacer strip 109 is fitted into the central groove 105 and sealing strips 111 are fitted into the side grooves 107. The presser plate 77 is placed onto the thickened upper portion 93 of the mullion body 75 with the insulating spacer strip 109 interposed therebetween and with the sealing strips 111 interposed between the presser plate 77 and the glazing panels P. Caulking compound may be provided outwardly along the sealing strips 111 to further enhance the sealing effect. For securing the presser plate 77 to the thickened upper portion 93 of the mullion body 75, a plurality of cap screws, spaced apart, or other threaded fasteners 113 project downwardly into self-tapping threaded engagement with an upwardly opening central recess 95 formed in the thickened upper portion 93 of the mullion body 75. The presser plate 77 further has a pair of side notches 115 formed one on each side. The cover 79 is of a channel shape and includes two side flanges 117 and two lugs 119 formed along the lower edges of the side flanges 117. The cover 79 is pressed against the presser plate 27 so as to bring the engaging lugs 119 into snap-in engagement with the side notches 115 of the presser plate 77.

Figure 6:
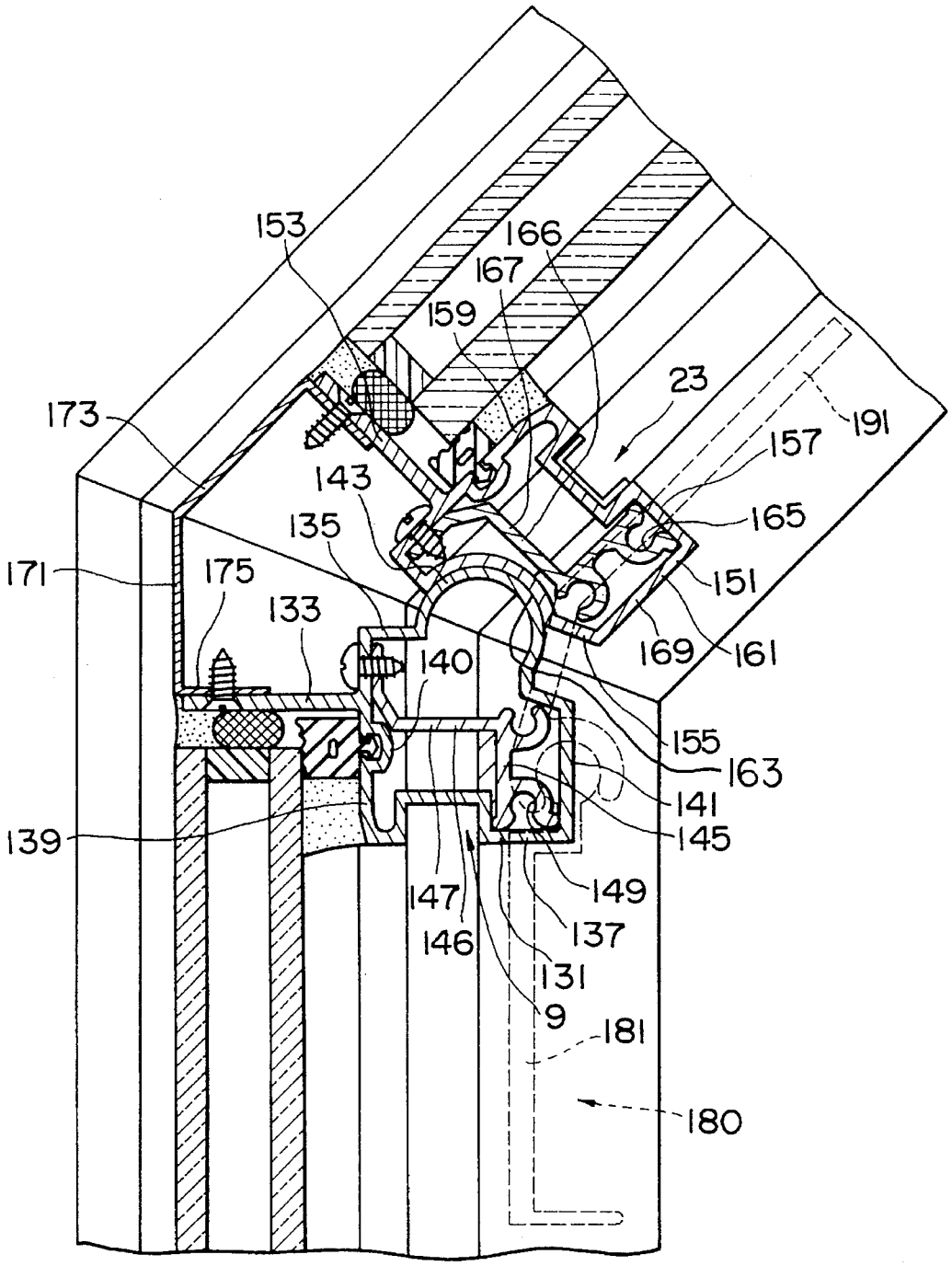
FIG. 6 is an enlarged vertical cross-sectional view taken on line VI—VI of FIG. 1.

As shown in FIG. 2, the head 9 is also an elongated profile preferably made of extruded aluminum. As shown in FIG. 6, the head 9 comprises a head hollow body 131 of substantially rectangular cross-section and an upstanding plate 133 formed on the upper side of the head hollow body 131. The head hollow body 131 is comprised of a pair of side plates 135, 137 and top and bottom plates 139, 141 joined at their respective opposed ends to the upper ends and the lower ends, respectively of the side plates 135 to provide a substantially rectangular hollow body 131. The left side plate 135 has convex 143 formed, as a first-mentioned circular arc surface, throughout its entire length. The upstanding plate 133 is formed perpendicularly on the top plate 139 so as to extend throughout the entire length thereof. An end bracket 146 is of a substantially L-shaped cross-section and includes a base 145 and a tail 147 extending substantially perpendicularly to one end of the base 145. The base 145 has two screw splines 149 formed on the opposed ends thereof.

As shown in FIG. 2, the bottom purlin 23 is also an elongated profile preferably made of extruded aluminum. As shown in FIG. 6, the bottom purlin 23 comprises a purlin hollow body 151 of substantially rectangular cross-section and an upstanding plate 153 formed on the upper side of the purlin hollow body 151. The purlin hollow body 151 is comprised of a pair of side plates 155, 157 and a top and bottom plates 159, 161 joined at their respective opposed ends to the upper ends and the lower ends, respectively of the side plates 155 to provide a substantially rectangular hollow body 151. The left side plate 155 has a concave 163 formed, as a second-mentioned circular arc surface, throughout its entire length. The upstanding plate 153 is formed perpendicularly on the top plate 159 so as to extend throughout the entire length thereof. An end bracket 166 is of a substantially L-shaped cross-section and includes a base 165 and a tail 167 extending substantially perpendicularly to one end of the base 165. The base 165 has two screw splines 169 formed on the opposed ends thereof.

A cover plate 171 is made of an elongated aluminum extruded profile and is comprised of a dog-legged major body 173 and a pair of flanges 175 provided one on each side of the major body 173.

Figure 5:
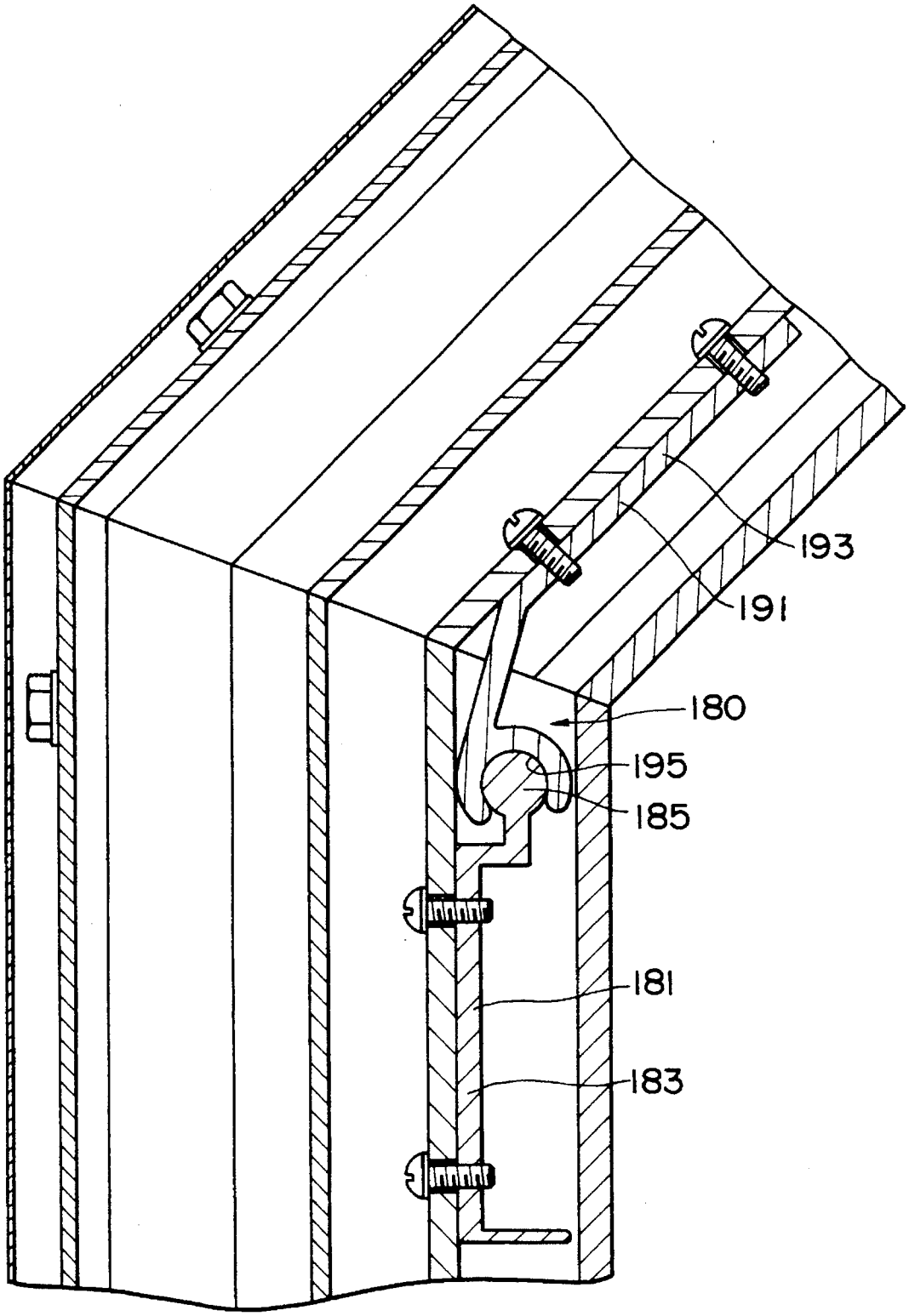
FIG. 5 is an enlarged vertical cross-sectional view taken on line V—V of FIG. 1.

As better shown in FIG. 5, there is provided means 180 for joining the lower ends of the rafters 17 and the upper ends of the mullions 13 so as to angularly adjusted to each other. The joining means 180 is comprised of a support bracket 181 and a hanging bracket 171. The support bracket 181 includes a flat support bracket body 183 and a circular head 185 integrally formed on and inwardly offset from the top of the bracket body 183. The hanging bracket 191 includes a somewhat dog-legged hanging bracket body 193 and a concave recess 195 formed in the bottom of the hanging bracket body 193. The hanging bracket 191 is joined to the support bracket 181 with the concave recess 195 of the former pivotally engaged with the circular head 185 of the latter.

Description will be now made of essential steps of the operation of installing the solarium structure whose essential parts has been explained hereinabove.

First, the upper end of each vertical mullion 13 and the lower end of each rafter 17 are mitered or cut at a desired angle. Then, as better shown in FIGS. 4 and 5, the support bracket 181 is fastened to the upper end of the rafter 17 by screwing the support bracket body 183 of the support bracket 181 to the inner surface of the top wall 85 of the vertical mullion 13. At this moment, the hanging bracket 191 is joined to the support bracket 181 with the concave recess 195 of the former is held in pivotal engagement with the circular head 185 of the latter, and with a larger part of the hanging bracket body 193 exposed beyond the upper end of the vertical mullion 13.

Then, as shown in FIG. 6, two end brackets 146 (only one shown in FIG. 6) are fastened to one on each side of the upper end of each vertical mullion 13 by screwing the screw splines 149 of the end bracket 146 to the side wall 83 of the vertical mullion 13. Then, the corresponding end of the elongated head 9 is snugly fitted over to the end bracket 146 and then fastened to the tail 147 of the end bracket 146 by means of screws. In this instance, the convex 143 projects upward beyond the upper edge of the vertical mullion 13. The repetition of this step on each vertical mullion 13 results in the vertical wall frame 3.

Then, as shown in FIG. 6, two end brackets 166 (only one shown in FIG. 6) are fastened to one on each side of the upper end of each rafter 17 by screwing the screw splines 169 of the end bracket 166 to the side wall 33 of the rafter 17. Then, the corresponding end of the elongated bottom purlin 23 is snugly fitted over to the end bracket 166 and then fastened to the tail 167 of the end bracket 166 by means of screws. In this instance, the concave 163 terminates short of the lower edge of the rafter 17. The repetition of this step on each rafter 17 results in the sloped roof frame 1.

Then, the sloped roof frame 1 is mounted on the vertical wall frame 3. In this instance, the lower end of each rafter is mitered to the upper end of each vertical mullion with the projecting support bracket body 183 sticking into the lower hollow base 30 of the rafter 17. As shown in FIG. 5, the inserted support bracket body 183 of the support bracket 181 is fastened to the top wall 35 of the rafter 17 by screws. Consequently, the lower ends of the rafters 17 and the upper ends of the mullions 13 are joined by the joining means 180 firmly and are prevented from detachment or displacement from each other especially laterally thereof even under severe stresses caused by heavy wind load. Furthermore, the concave 163 of the bottom purlin 23 is held in pivotal engagement with the convex 143 of the head 9.

The concave recess 195 of the hanging bracket 191 comes into pivotal engagement with the circular head 185 of the support bracket 181 so that the rafter 7 can be angularly adjusted relative to the vertical mullion 13, and the concave 163 of the bottom purlin 23 also comes into pivotal engagement with the convex 143 of the head 9 so that the bottom purlin 23 can be angular adjusted to the head 9; with the combined result that, conveniently, the sloped roof frame 1 can be angularly adjusted relative to the vertical wall frame 3 in conformity with any angle that the rafter 17 and the vertical mullion are mitered.

Then, as shown in FIG. 6, each cover plate is fitted between the upstanding plates 133, 153 of the head 9 and the bottom purlin 25, respectively, and fastened to these upstanding plates 133, 135 by means of screws for enhancing aesthetic quality of the solarium structure as a whole.

Then, double-glazing panels P are fitted into the glazing openings of the sloped roof frame 1 and the vertical wall frame 3. Finally, sealing strips are fitted and caulking are provided around the double glazing panels P.

Although, according to the preceding embodiment, the support bracket 181 has a circular head 185 and the hanging bracket 191 has a concave recess 195 for receiving the circular head 185; alternatively, the support bracket 181 may have a concave recess and the hanging bracket 191 may have a circular head for fitting theretinto.

Furthermore, in the preceding embodiment, the head 9 has a convex 143 and the bottom purlin 23 has a concave 163 for pivotal engagement therewith; alternatively, the head 9 may have a concave and the bottom purlin 25 has a convex.

Obviously, various modifications and variations of the present invention are possible in the light of the above teaching. It is therefore to be understood that within the scope of the appended claims the invention may be practiced otherwise than as specifically described.

What is claimed is:

1. A solarium structure comprising a vertical wall frame; a sloped roof frame mounted thereon; the vertical wall frame including two mullions, each having an upper end and a lower end, and a head having opposed ends joined with sides of the upper ends of the mullions, the head having a first circular-arc surface; the sloped roof frame including two rafters, each having an upper end and an opposed lower end, and a bottom purlin having opposed ends joined with sides of the lower ends of the rafters, the bottom purlin having second circular-arc surface; the lower ends of the rafters being mitered to the upper ends of the mullions; the bottom purlin being placed on the head with the second circular-arc surface coming into surface-to-surface engagement with the first circular-arc surface so that the head and bottom purlin can be angularly adjusted to each other and so that draft and light can be prevented from passing between the sloped roof frame and the vertical wall frame; and joining means for joining the lower ends of the rafters and the upper ends of mullions so as to be angularly adjusted to each other.

2. A solarium structure according to claim 1, the joining means comprising a support bracket, having a top and bottom, and fastened to the upper end of each mullion, said support bracket having a circular head formed on the top thereof; and a hanging bracket, having a top and a bottom, and fastened to the lower end of each rafter, said hanging bracket having a concave recess formed in the bottom thereof, the circular head of the support bracket being pivotally engaged with the concave recess of the hanging bracket.

3. A solarium structure according to claim 1, the joining means comprising a support bracket, having a top and bottom, and fastened to the upper end of each mullion, said support bracket fastened to the lower end of each rafter, said hanging bracket having a circular head formed on the bottom thereof, the concave recess of the support bracket being pivotally engaged with the circular head of the hanging bracket.

4. A solarium structure according to claim 1, the first circular-arc surface being concave and the second circular-arc surface being convex.

5. A solarium structure according to claim 1, the first circular-arc surface being convex and the second circular-arc surface being concave.

* * * * *